United States Patent [19]

McWilliams

[11] Patent Number: 4,910,387

[45] Date of Patent: Mar. 20, 1990

[54] INFRA-RED HEATERS

[75] Inventor: Joseph A. McWilliams, Droitwich, United Kingdom

[73] Assignee: Micropore International, Ltd., Worcester, United Kingdom

[21] Appl. No.: 230,652

[22] Filed: Aug. 5, 1988

Related U.S. Application Data

[63] Continuation of Ser. No. 2,795, Dec. 29, 1986, Pat. No. 4,789,772.

[30] Foreign Application Priority Data

Jun. 11, 1985 [GB] United Kingdom ..... 8514785

[51] Int. Cl.[4] ..... H05B 3/74

[52] U.S. Cl. ..... 219/464; 219/465; 219/468; 219/354

[58] Field of Search ..... 219/464, 465, 466, 458, 219/459, 460, 461, 468, 347, 349, 354

[56] References Cited

U.S. PATENT DOCUMENTS

| | | | |
|---|---|---|---|
| 2,614,200 | 10/1952 | McNair | 219/481 |
| 2,681,973 | 6/1954 | Macoicz | 219/481 |
| 2,959,662 | 11/1960 | Crowley | 219/481 |
| 4,535,221 | 8/1985 | Holsworth | 219/535 |
| 4,639,579 | 1/1987 | Brooks et al. | 219/464 |
| 4,645,911 | 2/1987 | Husslein | 219/464 |
| 4,665,307 | 5/1987 | McWilliams | 219/449 |
| 4,700,051 | 10/1987 | Goessler et al. | 219/464 |

FOREIGN PATENT DOCUMENTS

| | | | |
|---|---|---|---|
| 0103741 | 3/1984 | European Pat. Off. . | |
| 0117346 | 9/1984 | European Pat. Off. . | |
| 0134090 | 3/1985 | European Pat. Off. | 219/464 |
| 1159109 | 12/1963 | Fed. Rep. of Germany | 219/493 |
| 2731782 | 1/1979 | Fed. Rep. of Germany | 219/448 |
| 2808181 | 9/1979 | Fed. Rep. of Germany . | |
| 499032 | 1/1920 | France . | |
| 2083327 | 3/1982 | United Kingdom . | |
| 2154405 | 1/1984 | United Kingdom . | |

OTHER PUBLICATIONS

Lamps and Lighting, S. T. Henderson and A. M. Marsden (eds.), 1972, pp. 315–324.

The New Penguin Dictionary of Electronics, V. Pitt & J. Young (eds.), 1979, pp. 26–27.

*Primary Examiner*—Teresa J. Walberg

*Attorney, Agent, or Firm*—Browdy and Neimark

[57] ABSTRACT

An infra-red heater (1) for a glass ceramic top cooker includes a dish containing a base layer of thermal insulating material. A peripheral wall of thermal insulating material extends around the periphery of the base layer and at least one infra-red lamp (3) extends across the base layer. A ballast device (5) is electrically connected in series with the infra-red lamp, for example in the form of a coil of bare resistance wire, and serves to reduce inrush current to the lamp. A thermal cut-out device (7) cuts off the supply of power to the infra-red lamp and to the ballast device (5) if the temperature of the glass ceramic cooking surface becomes excessive. The coil of bare resistance wire preferably has an electrical resistance which is approximately half the electrical resistance of the infra-red lamp at its operating temperature. The use of a ballast device (5) enables the infra-red lamp (3) to be used in conjunction with a cyclic energy regulator (9).

27 Claims, 7 Drawing Sheets

INFRA-RED HEATERS

This is a continuation of parent co-pending application Ser. No. 002,795 deposited Feb. 9, 1987, filed as an international application on June 6, 1986 now U.S. Pat. No. 4,789,772.

The present invention relates to infra-red heaters which incorporate at least one infra-red lamp and which are provided with a ballast device.

It is well known to use cyclic energy regulators and multi-position electromechanical switches in order to control the energy output of the resistance element of conventional radiant heaters for use in glass ceramic top cookers. It is also known to use multi-position electromechanical switches to control infra-red heaters which incorporate a number of infra-red lamps. However, the use of multi-position switches requires a number of series and parallel interconnections of the infra-red lamps in order to obtain a usable range of energy outputs and in practice this requires that the infra-red heater incorporates at least three infra-red lamps.

A considerable proportion of the cost of such infra-red heaters is attributable to the lamps. It is therefore desirable to reduce the number of lamps in the heater in order to reduce costs. However, it becomes difficult to provide an effective control of the energy output with a reduced number of lamps.

Multi-position switches become impractical as the number of lamps is reduced and cyclic energy regulators also present a number of problems. For example, the electrical resistance of the filament of infra-red lamps is very low at ambient temperatures and this gives rise to high inrush currents when the lamp is energised which results in a high loading on the energy regulator contacts and can overload the domestic wiring system, thus tripping the protection circuit breaker. Further, an infra-red lamp has a high visible light output which gives rise to a disturbing flashing if the lamp is repeatedly turned on and off. Moreover, when a cyclic energy regulator is at a low setting, for example for simmering, the cycle will consist of a short on-period of full power followed by a long off-period and, due to the fast response of infra-red lamps compared with conventional resistance wire elements, can raise the contents of a cooking utensil to boiling point for a short period followed by a long cooling period instead of giving a continuous simmering condition.

It has also been proposed to reduce the number of lamps by employing an electronic energy regulator, but electronic controls are themselves expensive and can be unreliable in the demanding environment of an electric cooker.

It is an object of the present invention to provide an infra-red heater which incorporates at least one infra-red lamp and which overcomes the above-mentioned disadvantages when used in conjunction with a cyclic energy regulator.

According to the present invention there is provided an infra-red heater for a glass ceramic top cooker, which heater comprises:

- a dish;
- a base layer of thermal insulating material supported in the dish;
- a peripheral wall of thermal insulating material extending around the periphery of the base layer;
- a thermal cut-out device;

- at least one infra-red lamp extending across the base layer; and
- a ballast device electrically connected in series with the at least one lamp.

The heater may be combined with a cyclic energy regulator, which regulator at its full power setting may connect the at least one lamp directly with its power source.

The ballast device may comprise a coil of bare wire in the form of a ballast resistor. The ballast resistor preferably has an electrical resistance approximately half the resistance at operating temperature of the at least one lamp. The ballast resistor is preferably arranged in the peripheral region of the heater. The ballast resistor may comprise two coils of bare wire electrically connected in parallel. The coil comprising the ballast resistor may be straightened in regions where the coil passes adjacent to the at least one lamp.

A further heating element may be arranged adjacent to or around the peripheral wall, a further peripheral wall being provided around the further heating element. The further heating element may comprise an infra-red lamp having a ballast resistor electrically connected in series with the lamp or may comprise a coil of bare wire.

The ballast device may comprise a ballast reactor. The ballast reactor is preferably positioned externally of the metal dish of the heater.

The surface of the base layer of thermal insulation material may be contoured so as to influence the temperature distribution of the heater.

For a better understanding of the present invention and to show more clearly how it may be carried into effect reference will now be made, by way of example, to the accompanying drawings in which.

Figure 1:
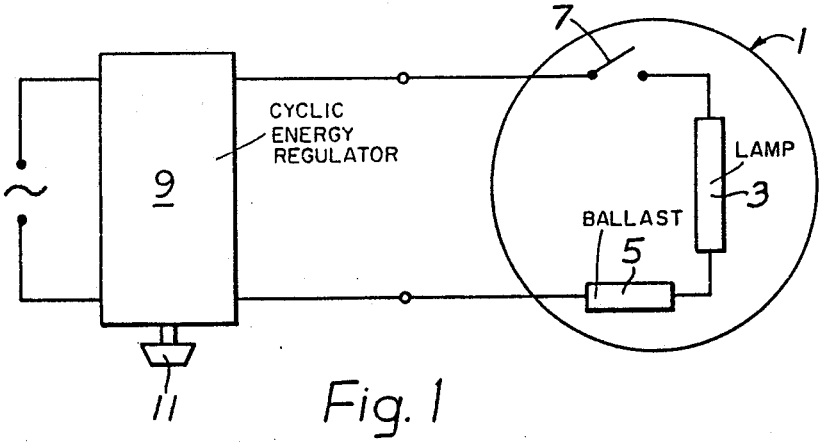
FIG. 1 is a diagrammatic representation of a first embodiment of an infra-red heater according to the present invention, together with a cyclic energy regulator.

FIG. 1 shows an infra-red heater 1 which incorporates an infra-red lamp 3, a ballast device in the form of a ballast resistor 5, and a thermal cut-out device 7. The infra-red heater 1 is electrically connected with a cyclic energy regulator 9, the energy level, or mark-to-space ratio, of which is determined by the position of a rotatable control knob 11.

The infra-red heater 1 comprises a base layer of thermal insulation material, such as a microporous thermal insulation material based on pyrogenic silica or ceramic fibre, and a peripheral ring of insulation material which, in use, prevents heat escaping between the base layer and the underside of the glass ceramic cooking surface (not shown in FIG. 1). The base layer, and if desired the peripheral ring, may be supported in a metal dish.

The infra-red lamp is arranged on or above the base layer and is electrically connected in series with the thermal cut-out device which serves to disconnect the lamp from its power source if the temperature of the glass ceramic cooking surface becomes excessive. The ballast resistor 5 is connected in series with the infra-red lamp 3 and power is supplied to the infra-red lamp 3 from the energy regulator 9 by way of the ballast resistor 5 at all settings of the rotatable knob. The electrical resistance of the ballast resistor is preferably approximately one half the resistance of the infra-red lamp 3 in its heated condition. The temperature resistance coefficient of the material of the ballast resistor should be relatively small and should be several times smaller than the temperature resistance coefficient of the material of the infra-red lamp.

Figure 2:
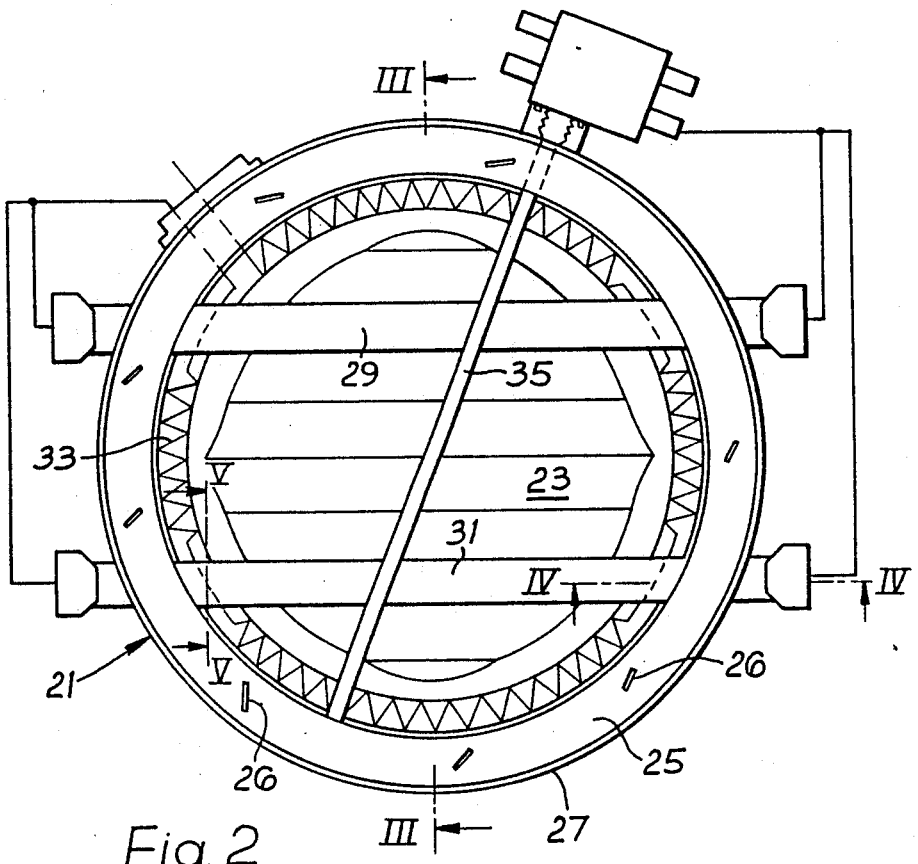
FIG. 2 is a plan view of a second embodiment of an infra-red heater according to the present invention.

FIG. 2 shows an infra-red heater 21 which comprises a base layer 23 of thermal insulation material such as a microporous thermal insulation material based on pyrogenic silica or ceramic fibre, a peripheral ring 25 of thermal insulation material such as ceramic fibre and a metal dish 27 supporting the base layer 23 and the peripheral ring 25. The peripheral ring 25 is held in position on the base layer 23 by means of staples 26. Two infra-red lamps 29, 31 are arranged on or above the base layer 23 and in use are electrically connected in parallel, and a ballast resistor 33 in the form of a coil of bare wire is arranged in a groove formed in the base layer 23 around the periphery of the heated area of the heater 21, the arrangement of the ballast resistor 33 around the periphery of the heated area giving rise to a preferred temperature distribution from the heater and optimum performance of the heater. A thermal cut-out device 35 extends across the heated area and serves to disconnect the lamps from their power source if, in use, the temperature of the glass ceramic cooking surface (not shown in FIG. 2) becomes excessive. In use, as with the embodiment described with reference to FIG. 1, power is supplied to the lamps 29, 31 by way of the ballast resistor 33. The electrical resistance of the ballast resistor 33 is preferably approximately half of the combined resistance of the infra-red lamps in their heated condition.

Figure 3:
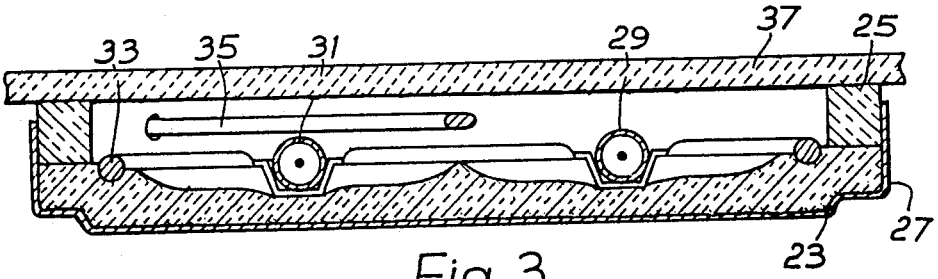
FIG. 3 is a cross-sectional view taken along the line III—III shown in FIG. 2.

The cross-sectional view shown in FIG. 3 is taken along the line III—III in FIG. 2 and the same reference numerals are used to denote corresponding elements. FIG. 3 shows the glass ceramic cooking plate 37 and also shows that the base layer 23 may have its surface contoured, for example with raised side walls and a central ridge as shown in FIG. 3, in order further to improve the temperature distribution across the heater.

Figure 4:
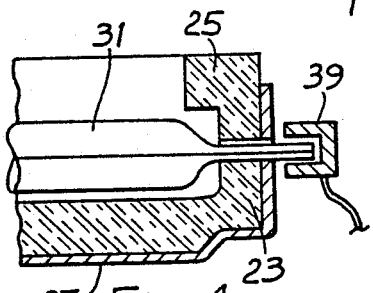
FIG. 4 is a cross-sectional view taken along the line IV—IV shown in FIG. 2.

The cross-sectional view shown in FIG. 4 is taken along the line IV—IV in FIG. 2 and the same reference numerals are used to denote corresponding elements. FIG. 4 shows that the infra-red lamp 31 is supported in its end region on the base layer 23 and is maintained in its position by means of the peripheral wall 25. This securely holds the lamp in position and ensures that visible light generated by the lamp within the heated area of the heater cannot escape. The staples 26 shown in FIG. 2 serve to hold the peripheral wall 25 in position. In order to eliminate any residual light that may escape from the heater, the end portions of the lamps may have an opaque coating. A ceramic end cap 39 provides an electrical connection to the lamp 31.

Figure 5:
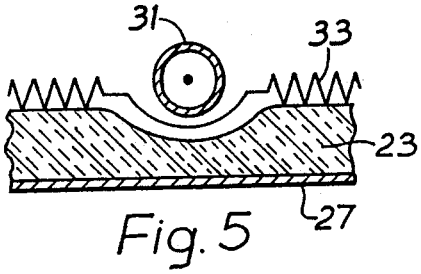
FIG. 5 is a cross-sectional view taken along the line V—V shown in FIG. 2.

The cross-sectional view shown in FIG. 5 is taken along the line V—V in FIG. 2 and the same reference numerals are used to denote corresponding elements. FIG. 5 shows that the coil of the ballast resistor 33 may be opened and formed to pass under the envelope of the infra-red lamp 31.

As an alternative to the use of staples 26 shown in FIG. 2 to hold the lamps 29, 31 in position by way of the peripheral wall 25, a spring clip may be used, the spring clip being positioned either internally or externally of the metal dish 27.

Figure 6:
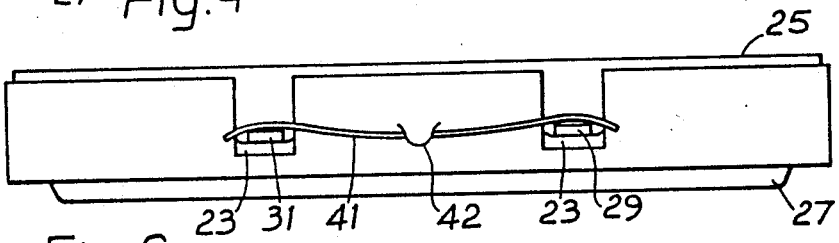
FIG. 6 is a side view of an infra-red heater according to the present invention showing a spring wire fastening clip.
Figure 7:
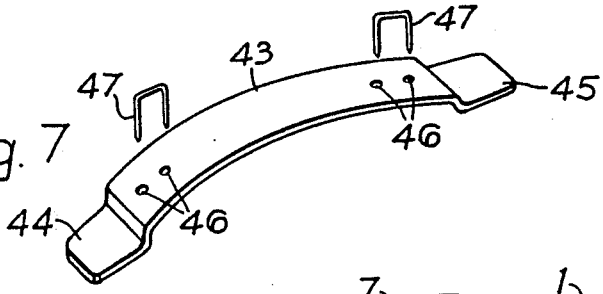
FIG. 7 is an exploded perspective view of an alternative fastening clip.

FIG. 6 shows a spring wire clip 41 positioned externally of the metal dish 27 and engaging over the end portions of lamps 29, 31. The lamps are biased towards the base layer 23 by passing the spring wire 41 intermediate its ends beneath a spring engaging clip 42 which extends radially outwardly from the metal dish 27. FIG. 7 shows a spring strip 43 which is to be positioned above the end portions of the lamps 29, 31 and the base layer 23, but below the peripheral wall 25. The end portions 44, 45 of the spring strip are depressed to engage with the end portions of the lamps 29, 31. Apertures 46 are provided in the spring strip 43 to receive staples 47 for more permanent retention of the spring strip against the end portions of the lamps and against the base layer 23.

We have found that the introduction of a ballast device in series with the infra-red lamp or lamps enables a relatively inexpensive infra-red heater to be produced inasmuch as only one or two infra-red lamps need to be used and also enables an inexpensive, readily available cyclic energy regulator to be used.

The use of a ballast device connected in series with the lamp or lamps ensures that the inrush current problem is overcome. It is a simple matter for a person skilled in the art to select a value for the ballast device which limits the inrush current to a level that is acceptable for standard domestic cooker supply wiring. The ballast device reduces the visible light output from the lamps and also reduces the rate at which the filament temperature rises, and hence the rate at which the visible light output rises. This reduces to an acceptable level the disturbance caused by the flashing as a result of on-off switching of the energy regulator. Because the lamp filament heats up more slowly, the problems of alternate boiling and cooking at low power settings of the energy regulator are avoided and steady simmering conditions can be achieved. Moreover, the ballast device results in lower peak inrush current and in a lower peak temperature of the lamp filament and consequently in reduced stress on the infra-red lamp or lamps. This considerably extends the working life of the infra-red lamp or lamps.

Figure 8:
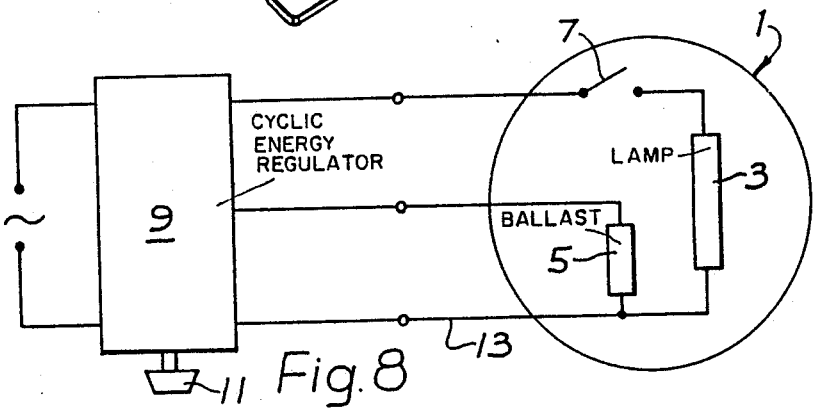
FIG. 8 is a diagrammatic representation of a third embodiment of an infra-red heater according to the present invention, together with a cyclic energy regulator.

The infra-red heater shown diagrammatically in FIG. 8 is similar to the heater shown in FIG. 1 and the same reference numerals are used to denote corresponding elements. However, in FIG. 8, although at all power settings other than full power energy is supplied to the infra-red lamp 3 by way of the ballast resistor 3, at full power electric current is supplied direct to the infra-red lamp 3 by way of power supply line 13. Because the power output from the heater during cycling of the energy regulator is reduced to approximately two-thirds of the power if the ballast device is not connected, the cyclic energy regulator 9 is constructed in such a way that the full power setting can only be achieved by first passing through the lower power settings. The elimination of the ballast device at full power can in some embodiments allow the infra-red lamp or lamps to operate at higher power for optimum performance and minimum boiling times for the contents of a cooking utensil.

Figure 9:
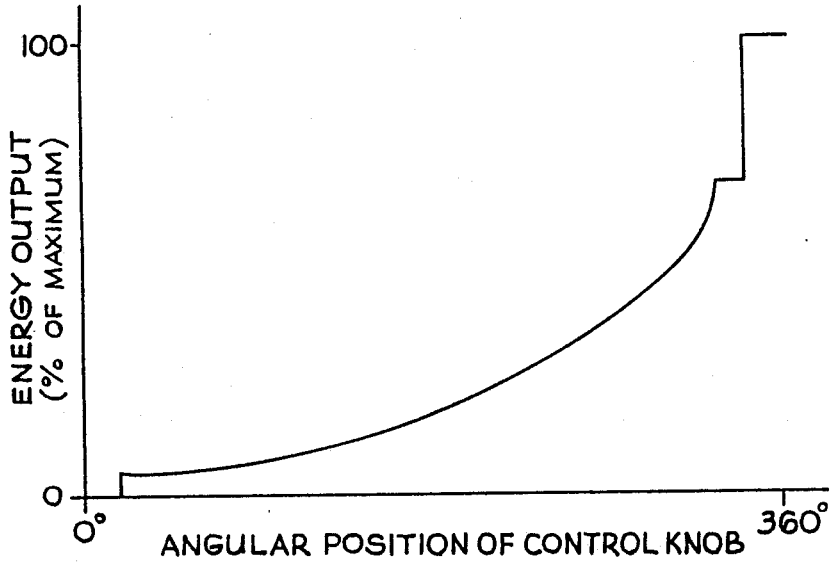
FIG. 9 is a graph showing the energy output of the heater illustrated in FIG. 8 as a function of the angular position of the energy regulator control knob.

FIG. 9 is a graph of energy output and corresponds to the embodiment of FIG. 8. FIG. 9 shows that full energy output is delivered at full rotation of the control knob, but that this falls to approximately two-thirds of full power as soon as the ballast resistor is switched in series with the lamp or lamps. As the control knob is turned progressively towards its minimum setting the energy output decreases and, at the minimum setting, the energy output is lower than would be achievable in the absence of the ballast resistor, thus giving an extended range of low power settings for warming and simmering.

Figure 10:
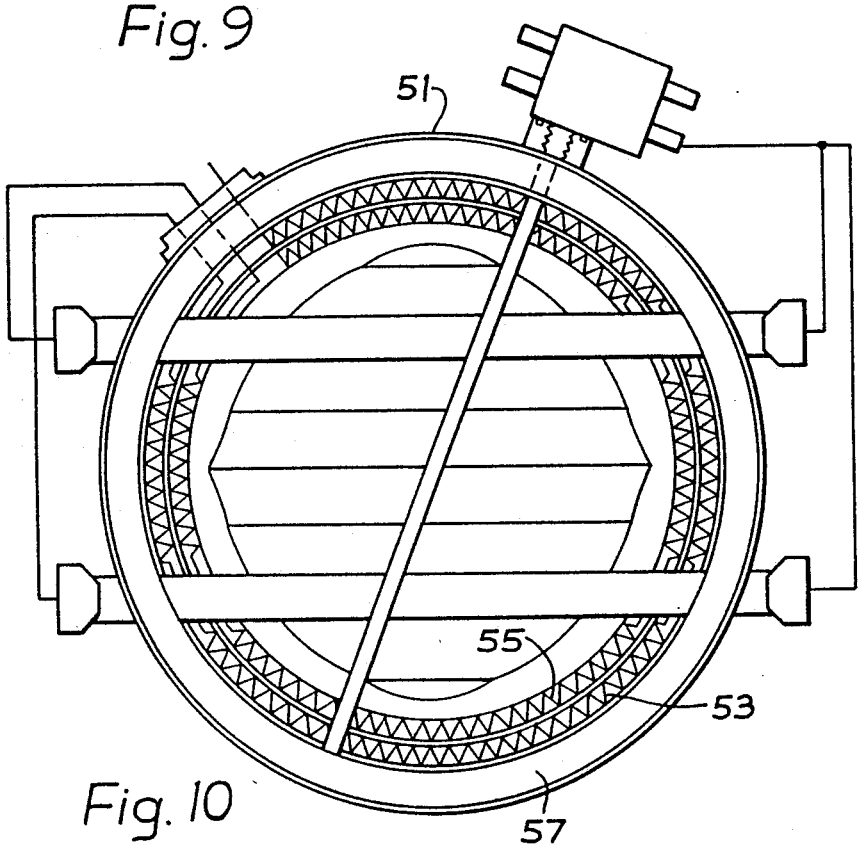
FIG. 10 is a plan view of a fourth embodiment of an infra-red heater according to the present invention.

FIG. 10 shows an infra-red heater 51 similar to the heater illustrated in FIG. 2. However, in the embodiment shown in FIG. 10, the watts rating of the ballast resistor is such that it is necessary, or desirable, to accommodate the ballast resistor in two concentric coils 53, 55 arranged adjacent to the peripheral wall 57, instead of a single coil 33. The concentric coils can be electrically connected in series, or with appropriate values can be electrically connected in parallel. Parallel connection reduces the overall mass of wire in the ballast resistor and consequently increases the rate at which the ballast resistor rises to its operating temperature.

Figure 11:
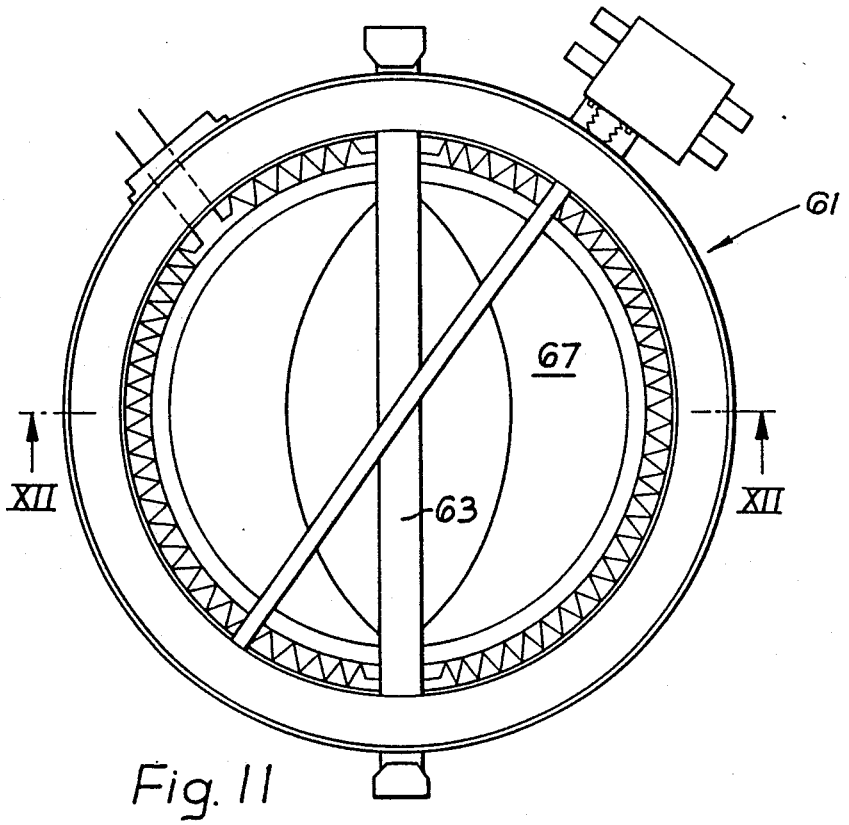
FIG. 11 is a plan view of a fifth embodiment of a infra-red heater according to the present invention.
Figure 12:
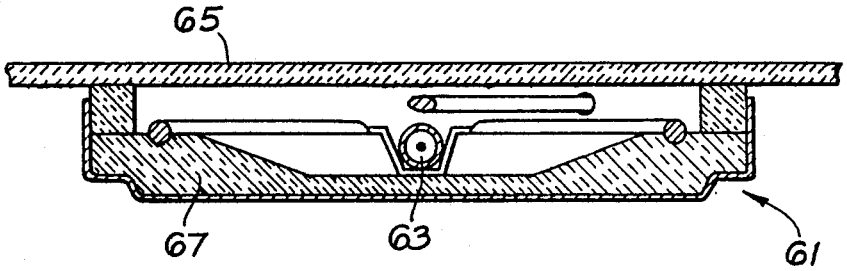
FIG. 12 is a cross-sectional view taken along the line XII—XII shown in FIG. 11.

FIGS. 11 and 12 show an infra-red heater 61 similar to the heater illustrated in FIGS. 2 and 3, except that the heater 61 incorporates only a single infra-red lamp 63. The use of a single lamp can give rise to an unacceptable temperature distribution across the glass ceramic plate 65, but we have found that a contoured surface of the base layer 67 of thermal insulation material significantly improves the temperature distribution. The upper portion, as shown in FIGS. 11 and 12, of the lamp may be coated with a reflective layer (not shown) in order further to improve the temperature distribution by reflecting upwardly emitted radiation back towards the base layer of thermal insulation material.

Figure 13:
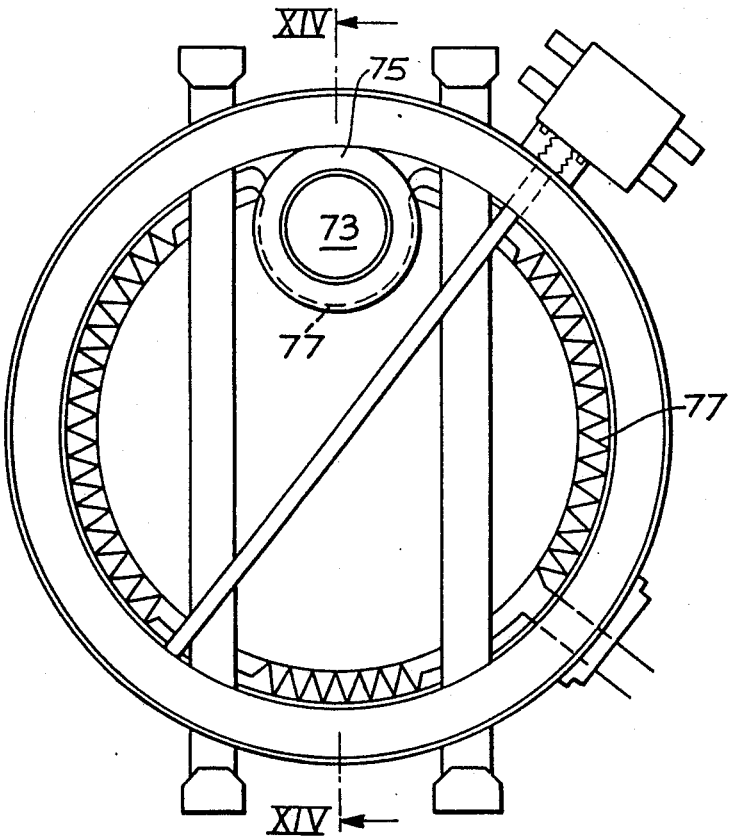
FIG. 13 is a plan view of a sixth embodiment of an infra-red heater according to the present invention.
Figure 14:
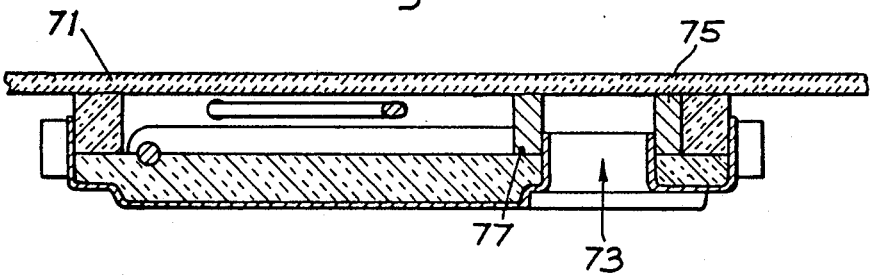
FIG. 14 is a sectional view taken along the line XIV—XIV shown in FIG. 13.

FIGS. 13 and 14 show an infra-red heater according to the present invention which has been modified to incorporate, in use, a cooking utensil temperature sensor (not shown) which senses the temperature of a cooking utensil through the glass ceramic plate 71. Such a heater is known as an "autocook" heater. The temperature sensor is accommodated in an aperture 73 formed through the base of the heater adjacent to the periphery of the heater and the aperture 73 is surrounded by a wall 75 of thermal insulation material to shield the temperature sensor from heat emitted by the heater. In the region of the aperture 73, the ballast resistor 77 is straightened to reduce heat emission and passes within the wall 75 of thermal insulation material.

Figure 15:
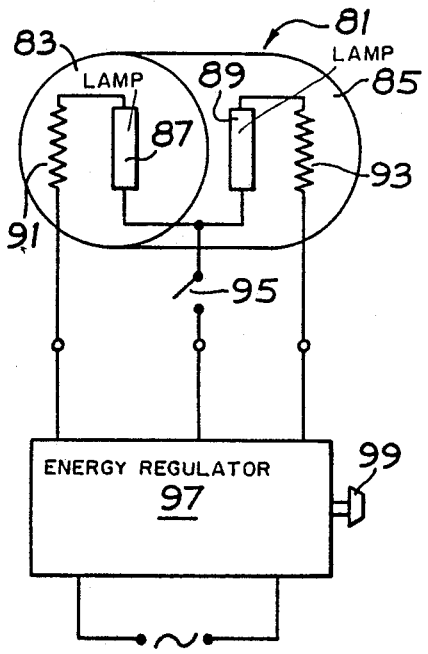
FIG. 15 is a diagrammatic representation of a seventh embodiment of an infra-red heater according to the present invention, together with a cyclic energy regulator.

FIG. 15 shows diagrammatically how an infra-red heater 81 may be constructed with two distinct heating zones 83, 85 each with an infra-red lamp 87, 89 and a ballast resistor 91, 93. A thermal cut-out device 95 serves to disconnect both lamps 87, 89 and the ballast resistors 91,93 from the power source if the temperature of the glass ceramic cooking surface becomes excessive. Power is supplied to the heater from an energy regulator 97 at an energy level depending upon the setting of a rotatable knob 99. Either the heating zone 83 or both heating zones 83, 85 may be selected by a switch which may be incorporated, for example, in the rotatable knob 99.

Figure 16:
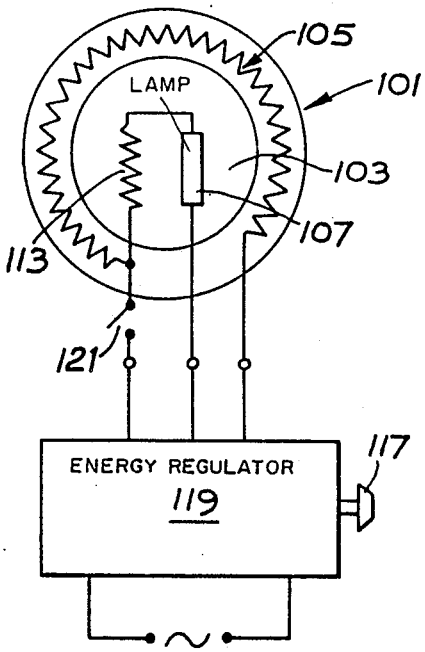
FIG. 16 is a diagrammatic representation of an eighth embodiment of an infra-red heater according to the present invention, together with a cyclic energy regulator.
Figure 17:
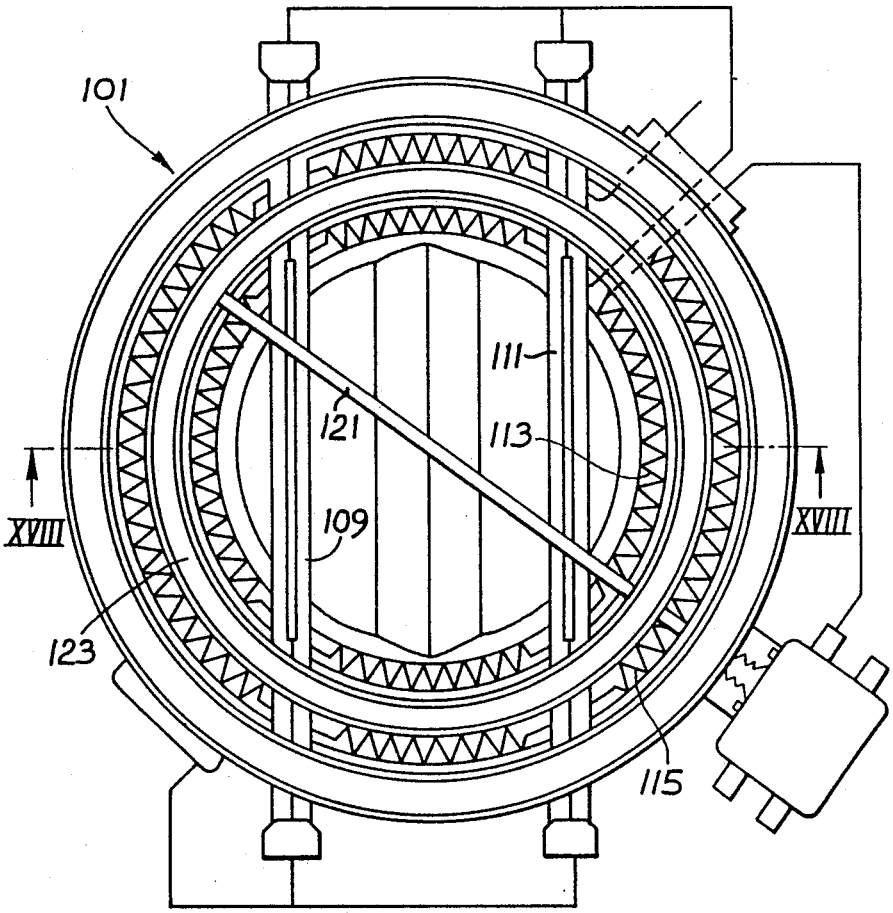
FIG. 17 is a plan view of the infra-red heater represented diagrammatically in FIG. 16.
Figure 18:
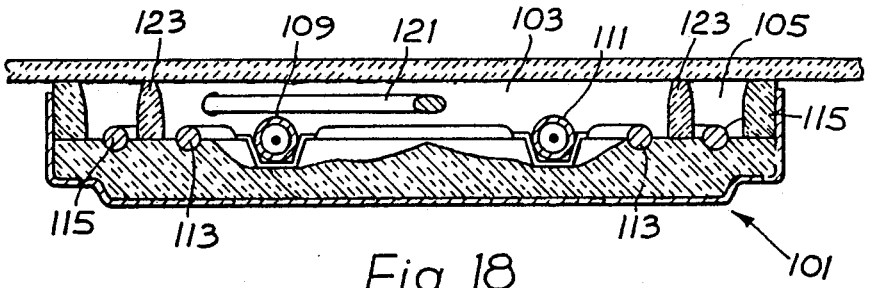
FIG. 18 is a cross-sectional view taken along the line XVII—XVII shown in FIG. 17.

FIGS. 16, 17 and 18 show an alternative embodiment of an infra-red heater 101 having two distinct heating zones 103, 105. The heating zone 103 is provided with a source of infra-red radiation 107 in the form of two infra-red lamps 109, 111 and with a ballast resistor 113 electrically connected in series with the lamps. A conventional heating coil 115 in the form of a helical coil of bare wire is arranged in an annular heating zone 105 around the heating zone 103 and is electrically connected in parallel with the lamps 109, 111 and the ballast resistor 113 when a switch, for example incorporated into a rotatable knob 117 of an energy regulator 119, is actuated. A thermal cut-out device 121 serves to disconnect the lamps 109, 111, the ballast resistor 113 and the heating coil 115 from the power source if the temperature of the glass ceramic cooking surface 121 becomes too high. The lamps 109, 111 may be adapted to the dimensions of the heating zone 103 by restricting the infra-red radiating filament of the lamps to the diameter of the heating zone 103 and further may be adapted by coating those portions of the lamps which are outside the heating zone 103 with an opaque material. The heating zones 103, 105 are separated by a dividing wall 123 of thermal insulation material and a close fit between the walls of an aperture formed through the dividing wall 123 and the envelope of the respective lamp 109, 111 assists in preventing the escape of any visible radiation. Where the heating coil 115 passes beneath the thermal cut-out device 121, the helical coil may be stretched to reduce heat emission in this region. As a further precaution, the thermal cut-out device 121 may be thermally insulated from heat emitted by the heating coil 115 by means of a block of thermal insulation material (not shown).

Figure 19:
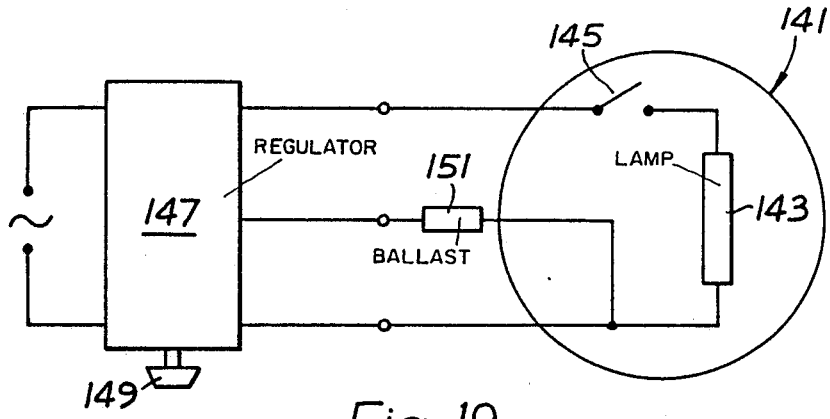
FIG. 19 is a diagrammatic representation of a ninth embodiment of an infra-red heater according to the present invention, together with a cyclic energy regulator.

In the embodiment shown in FIG. 19, the infra-red heater 141 incorporates an infra-red lamp 143 and a thermal cut-out device 145. The infra-red heater 141 is electrically connected with a cyclic energy regulator 142, the energy level of which is determined by the position of a rotatable control knob 149. In one of the electrical lines from the heater 141 to the regulator 147 there is arranged a ballast device in the form of a ballast reactor in series with the infra-red lamp 143. As with the embodiment of FIG. 8, the infra-red heater 141 comprises a base layer of thermal insulation material such as microporous thermal insulation material based on pyrogenic silica or ceramic fibre and a peripheral ring of insulation material which, in use, prevents heat escaping between the base layer and the underside of the glass ceramic cooking surface. The base layer and, if desired, the peripheral wall may be supported in a metal dish.

The infra-red lamp 143 is arranged on or above the base layer of thermal insulation material and is electrically connected in series with the thermal cut-out device 145 which serves to disconnect the infra-red lamp 143 from its power source if the temperature of the glass ceramic cooking surface becomes excessive. The ballast reactor 151 is connected in series with the lamp 143 and power is supplied to the lamp from the energy regulator 147 by way of the ballast reactor at all settings of the control knob 149 except at the full power position in which electric current is supplied directly to the lamp 143 as described with reference to FIG. 8.

I claim:

1. An infra-red heater for a glass ceramic top cooker, which heater comprises:

a dish;

a base layer of microporous thermal insulating material supported in the dish and having an upper surface and two generally concave depressions extending below said surface;

a peripheral wall of thermal insulating material extending around the periphery of the base layer;

two infra-red lamps each extending across the base layer above one of said depressions;

said lamps having filaments which together have a first electrical resistance when the lamps are at ambient temperature and a second electrical resistance higher than said first resistance when the lamps are at operating temperature;

a ballast device comprising a coil of electrical resistance wire extending around said heater adjacent said peripheral wall;

means coupling said ballast device in series with said infra-red lamps;

said ballast device having an electrical resistance approximately half said second electrical resistance of said filaments, whereby said ballast device limits inrush current upon energization of said lamps when said filaments are in their first electrical resistance condition; and a thermal cutout device connected to said lamps for controlling energization thereof in accordance with temperature.

2. The infra-red heater of claim 1, wherein said depressions comprise contoured regions having at least in part a width greater than twice their depth.

3. The infra-red heater of claim 1, wherein the coil is straightened in regions where the coil passes adjacent the lamps.

4. An infra-red heater for a glass ceramic top cooker, which heater comprises:

a dish;

a base layer of microporous thermal insulating material supported in the dish and having an upper surface and at least one generally concave depression extending below said surface;

a peripheral wall of thermal insulating material extending around the periphery of the base layer;

infra-red source means which comprises at least one infra-red lamp extending over the base layer above said depression and which has filament means having a first electrical resistance at ambient temperature and a second electrical resistance higher than said first resistance at operating temperature;

a ballast device comprising a coil of electrical resistance wire extending over said base layer in a generally circular configuration;

means coupling said ballast device in series with said infra-red source means;

said ballast device having an electrical resistance approximately half said second electrical resistance of said filament means, whereby said ballast device provides limitation of inrush current upon energization of said infra-red source means when said filament means is in its first electrical resistance condition; and a thermal output device connected to said infra-red source means for controlling energization thereof in accordance with temperature.

5. The infra-red heater of claim 4, wherein said at least one depression comprises a contoured region having at least in part a width greater than twice its depth.

6. An infra-red heater for a glass ceramic top cooker, which heater comprises:

a dish;

a base layer of microporous thermal insulating material supported in the dish and having an upper surface and at least one generally concave depression extending below said surface;

a peripheral wall of thermal insulating material extending around the periphery of the base layer;

infra-red source means which comprises at least one infra-red lamp extending over the base layer above said depression and which has filament means having a first electrical resistance at ambient temperature and a second electrical resistance higher than said first resistance at operating temperature;

a ballast device comprising a coil of electrical resistance wire extending over said base layer in a generally circular configuration adjacent said peripheral wall;

means coupling said ballast device in series with said infra-red source means;

said ballast device having an electrical resistance at least half said second electrical of said filament means, whereby said ballast device provides limitation of inrush current upon energization of said infra-red source means when said filament means is in its first electrical resistance condition; and a thermal cutout device connected to said infra-red source means for controlling energization thereof in accordance with temperature.

7. The infra-red heater of claim 6, wherein said at least one depression comprises a contoured region having at least in part a width greater than twice its depth.

8. An infra-red heater for a glass ceramic top cooker, which heater comprises:

a dish;

a base layer of microporous thermal insulating material supported in the dish and having an upper surface and two generally concave depressions extending below said surface;

a peripheral wall of thermal insulating material extending around the periphery of the base layer;

two infra-red lamps each extending across the base layer above one of said depressions;

said lamps having filaments which together have a first electrical resistance when the lamps are at ambient temperature and a second electrical resistance higher than said first resistance when the lamps are at operating temperature;

a ballast device comprising a coil of electrical resistance wire extending around said heater adjacent said peripheral wall;

means coupling said ballast device in series with said infra-red lamps;

said ballast device having an electrical resistance at least half said second electrical resistance of said filaments, whereby said ballast device limits inrush current upon energization of said lamps when said filaments are in their first electrical resistance condition; and a thermal cutout device connected to said lamps for controlling energization thereof in accordance with temperature.

9. The infra-red heater of claim 8, wherein said depressions comprise contoured regions having at least in part a width greater than twice their depth.

10. The infra-red heater of claim 8, wherein the coil is straightened in regions where the coil passes adjacent the lamps.

11. An infra-red heater for a glass ceramic top cooker, which heater comprises:

a dish;

a base layer of thermal insulating material supported in the dish and having at least one generally concave depression having at least in part a width greater than twice its depth;

a peripheral wall of thermal insulating material extending around the periphery of the base layer;

at least one infra-red lamp extending across the base layer above said depression and including a filament which has a first electrical resistance when the lamp is at ambient temperature and a second electrical resistance when the lamp is at operating temperature;

a ballast device electrically connected in series with said at least one lamp and extending around said heater adjacent said peripheral wall;

a thermal cutout device connected to said at least one lamp for controlling energization thereof.

12. An infra-red heater according to claim 11, wherein the ballast device comprises a ballast reactor.

13. An infra-red heater according to claim 11, wherein in that the heater is combined with a cyclic energy regulator.

14. An infra-red heater according to claim 2, wherein in that the energy regulator (9, 147) at its full power setting connects the at least one lamp directly with its power source,

15. An infra-red heater according to claim 11, wherein the ballast device comprises a coil (33, 53, 55, 77, 113) of bare wire in the form of a ballast resistor.

16. An infra-red heater according to claim 15, wherein the ballast resistor has an electrical resistance approximately half the resistance at operating temperature of the at least one lamp.

17. An infra-red heater according to claim 15, wherein the ballast resistor comprises two coils of bare wire electrically connected in parallel.

18. An infra-red heater according to claim 15 wherein the coil comprising the ballast resistor is straightened in regions where the coil passes adjacent to the at least one lamp.

19. An infra-red heater according to claim 15 wherein a further heating element is arranged adjacent to or around the peripheral wall, and a further peripheral wall extends around the further heating element.

20. An infra-red heater according to claim 19, wherein the further heating element comprises an infra-red lamp having a ballast resistor electrically connected in series with the lamp.

21. An infra-red heater according to claim 19, wherein the further heating element comprises a coil of bare wire.

22. An infra-red heater according to claim 11, wherein said depression is a shallow, trough-like depression extending to at least one side of said lamp as far as the peripheral region of the heater.

23. An infra-red heater according to claim 11, including at least two lamps and wherein said base layer of thermal insulating material has a shallow, trough-like depression under each lamp and extends approximately halfway between that lamp and the adjacent lamp.

24. An infra-red heater according to claims 22 or 23, wherein a portion of a surface of each depression is flat.

25. An infra-red heater according to claim 11, wherein said base layer of thermal insulating material has two depressions separated from each other by a central ridge.

26. An infra-red heater according to claim 11, including two infra-red lamps and wherein said ballast device comprises at least one coil of electrical resistance wire straightened in regions where the coil passes adjacent the lamps, and the base layer of thermal insulation material has two shallow, generally concave depressions each extending under a respective one of said lamps so as to influence the temperature distribution across the heater, said depressions being separated by a central ridge in the base layer.

27. An infra-red heater for a glass ceramic top cooker, which heater comprises:

a dish;

a base layer of microporous thermal insulating material supported in the dish;

a peripheral wall of thermal insulating material extending around the periphery of the base layer;

infra-red source means extending over the base layer and including filament means which has a first electrical resistance at ambient second electrical resistance higher than said first resistance at operating temperature;

a ballast device comprising a coil of electrical resistance wire extending around said heater adjacent said peripheral wall;

said ballast device having an electrical resistance at least half said second electrical resistance of said filament means, whereby said ballast device provides limitation of inrush current upon energization of said infra-red source means when said filament means is in its first electrical resistance condition; and a thermal cutout device connected to said infra-red source means for controlling energization thereof in accordance with temperature.

* * * * *